US006007701A

United States Patent [19]

Sherman et al.

[11] Patent Number: 6,007,701

[45] Date of Patent: Dec. 28, 1999

[54] METHOD OF REMOVING CONTAMINANTS FROM USED OIL

[75] Inventors: Jeffrey H. Sherman, Dallas, Tex.; Richard T. Taylor, Oxford, Ohio

[73] Assignee: Miami University, Oxford, Ohio

[21] Appl. No.: 09/250,741

[22] Filed: Feb. 16, 1999

[51] Int. Cl.[6] ..... C10M 175/00

[52] U.S. Cl. ..... 208/181; 208/179

[58] Field of Search ..... 208/181, 183, 208/179

[56] References Cited

U.S. PATENT DOCUMENTS

| | | | |
|---|---|---|---|
| 2,902,428 | 6/1959 | Kimberlin, Jr. et al. | 208/87 |
| 3,793,184 | 2/1974 | Loftus | 208/281 |
| 4,073,719 | 2/1978 | Whisman et al. | 208/180 |
| 4,097,369 | 6/1978 | Ebel et al. | 208/181 |
| 4,431,524 | 2/1984 | Norman | 208/181 |
| 4,437,981 | 3/1984 | Kovach | 208/253 |
| 4,915,818 | 4/1990 | Yan | 208/251 R |
| 5,626,742 | 5/1997 | Brons et al. | 208/435 |

*Primary Examiner*—Helane Myers
*Attorney, Agent, or Firm*—Michael A. O'Neil

[57] ABSTRACT

In a method of removing acidic compounds, color, and polynuclear aromatic hydrocarbons, and for removing or converting hydrocarbons containing heteroatoms from used oil distillate, phase transfer catalysts are employed to facilitate the transfer of inorganic or organic bases to the substrate of the oil distillate. An inorganic or organic base, a phase transfer catalyst selected from the group including quaternary ammonium salts, polyol ethers and crown ethers, and used oil distillate are mixed and heated. Thereafter, contaminants are removed from the used oil distillate through distillation.

9 Claims, 1 Drawing Sheet

METHOD OF REMOVING CONTAMINANTS FROM USED OIL

TECHNICAL FIELD

This invention relates generally to the removal of contaminants from used oil, and more particularly to a method of removing acidic compounds, color, and polynuclear aromatic hydrocarbons, and removing or converting heteroatoms from used oil distillates.

BACKGROUND AND SUMMARY OF THE INVENTION

Each year, about 20 million tons (150 million barrels) of used lubricating oils, such as automotive lubricating oils, gear oils, turbine oils and hydraulic oils which through usage or handling have become unfit for their intended use, are generated world-wide. Used oil accumulates in thousands of service stations, repair shops and industrial plants, derived from millions of cars and other machines. Lubricating oil does not wear out during use, but does become contaminated with heavy metals, water, fuel, carbon particles and degraded additives. Eventually the lubricating oil is so contaminated that it can not satisfactorily perform its lubricating function and must therefore be replaced. Most of this used oil is dumped (legally or illegally) or burned as low-grade fuel, but such methods of disposal are highly detrimental to the environment and can cause serious pollution. Public opinion and governmental requirements are increasingly demanding the recycling, rather than the burning or dumping, of waste products. Used lubricating oil may contain 60 to 80% highly valuable base oil (generally comprising mineral oil fractions with a viscosity of not less than 20 cSt at 40 degrees Centigrade), worth significantly more than heavy fuel oil. It is therefore desirable to extract and reuse this base oil.

To date, however, recycling has not generally been undertaken by the refiners of crude oil. This is because, although used oil represents a sizable raw material source for re-refining, its volume is relatively small in relation to the world's crude oil requirements, which currently exceed 9 million tons (65 million barrels) a day. In addition, used oil is contaminated by impurities which can cause expensive disruption and downtime in conventional large crude oil refineries. Furthermore, since used oil does not generally originate from one source in large volumes, its collection and handling require resources which are incompatible with the normal raw material logistics of large oil companies.

It has been known since the early 1900s that used lubricating oil from engines and machinery can be recycled. Such recycling grew and developed with the popularization of the automobile. During the Second World war, re-refining became more widespread due to the difficulties in supplying virgin lubricating oil. Used oil re-refining still continued in the 1960s and 1970s, but then became uneconomical. This was because the conventional re-refining processes at that time involved the addition of sulphuric acid in order to separate the contaminants from the useful hydrocarbon components of the used oil, thereby generating as a waste product a highly toxic acid sludge. With the increased use of performance-enhancing oil additives towards the end of the 1970s, the amount of acid sludge generated by conventional re-refining plants grew to an unacceptable level. In the United States of America, it has been reported by the American Petroleum Institute that, as a consequence of legislation prohibiting the land filling of acid sludge generated by conventional re-refining operations, the number of used oil re-refining plants has dropped from 160 in the 1960s to only three today.

As an alternative to the acid treatment process for the re-refining of used oil, various evaporation/ condensation processes have been proposed. In an attempt to obtain high operating efficiency, it is generally suggested that thin film evaporators be used. These evaporators include a rotating mechanism inside the evaporator vessel which creates a high turbulence and thereby reduces the residence time of feedstock oil in the evaporator. This is done in order to reduce coking, which is caused by cracking of the hydrocarbons due to impurities in the used oil. Cracking starts to occur when the temperature of the feedstock oil rises above 300 degrees Centigrade, worsening significantly above 360 to 370 degrees Centigrade. However, any coking which does occur will foul the rotating mechanism and other labyrinthine mechanisms such as the tube-type heat exchangers which are often found in thin film evaporators. These must therefore be cleaned regularly, which leads to considerable downtime owing to the intricate structure of the mechanisms.

It is known from WIPO Document Number WO-91/17804 dated November, 1991, to provide an evaporator which may be used in the re-refining of used oil by distillation. This evaporator comprises a cyclonic vacuum evaporator in which superheated liquid is injected tangentially into a partially evacuated and generally cylindrical vessel. The inside of the vessel is provided with a number of concentric cones stacked on top of one another which serve to provide a ref lux action. As a result of coking, however, the evaporator still needs to be shut down periodically in order to undertake the intricate and time-consuming task of cleaning the cones.

U.S. Pat. No. 5,814,207 discloses an oil rerefining method and apparatus wherein a re-refining plant comprises two or more evaporators connected to one another in series. Feedstock used oil is first filtered to remove particles and contaminants above a predetermined size, for example 100 to 300 $\mu$m, and is then passed to the first evaporator by way of a buffer vessel and a preheating tank, where the feedstock is heated to approximately 80 degrees Centigrade. Additional chemical additives, such as caustic soda and/or potash, may be introduced at this stage. The feedstock is then injected substantially tangentially into the first evaporator, in which the temperature and pressure conditions are preferably from 160 to 180 degrees Centigrade and 400 mbar vacuum to atmospheric pressure respectively. Under these conditions, water and light hydrocarbons (known as light ends, with properties similar to those of naphtha) are flashed off and condensed in the spray condenser of the evaporator and/or in an external after-condenser. These fractions generally account for between 5 to 15% of the used oil volume. The cyclonic vacuum evaporation process combined with the use of a spray condenser produces a distilled water which has a relatively low metal and other contaminant content. Light ends present in the water are then separated, and may be used as heating fuel for the re-refining process. The water may be treated in order to comply with environmental regulations and may be discharged or used as a coolant or heating fluid in the re-refining process. The bottoms product, comprising the non-distilled 85 to 95% of the used feedstock oil, is recirculated as described above. In the recirculation circuit, the bottoms product is heated, preferably to 180 to 200 degrees Centigrade, and mixed with the primary feedstock supply for reinjection into the first evaporator. Advantageously, the pump in the recirculation circuit generates a recirculation flow rate greater than the initial feedstock flow rate. This helps to reduce coking in the recirculation pipes since overheating of the oil in the heat exchanger is avoided. The recirculation flow rate should be large enough to generate a well turbulent flow, and accordingly depends on the heat exchanger duty and on the size of the pipe lines. This is typically achieved with a recirculation flow rate 5 to 10 times greater than the initial feedstock flow rate.

A proportion of the recirculating bottoms product from the first evaporator is fed to and injected into a second evaporator. This second evaporator is substantially similar to the first evaporator, but the temperature and pressure conditions are preferably from 260 to 290 degrees Centigrade and 40 to 100 mbar vacuum respectively. Under these conditions, a light fuel oil (similar to atmospheric gas oil) and a spindle oil (having a viscosity at 40 degrees Centigrade of about 15 cSt) are flashed off as overhead products, leaving behind a bottoms product from which the base oil distillate is to be recovered. These gas oil and spindle oil fractions generally account for between 6 to 20% of the original used oil volume. The condensed fractions are fed to storage and may be subjected to a finishing treatment, the severity of which will be determined by final usage and market requirements. The bottoms product of the second evaporator is recirculated as in the first evaporator, but at a temperature preferably in the region of 280 degrees Centigrade, and a proportion of the recirculated product is fed to and injected into a third evaporator.

The third evaporator preferably operates at temperature and pressure conditions of around 290 to 330 degrees Centigrade and 15 to 25 mbar vacuum respectively. These operating values may be varied within predetermined limits (generally +/−10%) to suit the required distillate output products. Advantageously, the third evaporator is in communication with first and second spray condensers. The second spray condenser serves to condense some of the lighter fractions from the vapor phase which passes through the first spray condenser.

Two base oil fractions are produced in the third stage as overhead distillate products and fed to storage. The first and second spray condensers, operating at elevated temperatures (100 to 250 degrees Centigrade) allow a partial condensation whereby two specific distillate fractions can be produced. The spray condensers have the added advantage that the temperature as well as the recirculation flow rate can be varied, thereby allowing a flexible fractionation. The viscosity of the fractions may be altered by adjusting the ratio of temperature to recirculation flow rate; by increasing the condenser temperature, a heavier oil fraction can be produced. The base oil fractions extracted by the third evaporator generally account for about 10 to 50% of the used oil volume. The bottoms product is recirculated at around 330 degrees Centigrade as before, and a proportion of the recirculated product is fed to and injected into a fourth evaporator.

The fourth evaporator preferably operates at temperature and pressure conditions of around 320 to 345 degrees Centigrade and 5 to 15 mbar vacuum respectively. Further base oil fractions, which are heavier than those extracted in the third stage, are flashed off as overhead products and are condensed as base oil distillate fractions and fed to storage. In certain embodiments, the evaporator may be operated in a blocked manner, whereby a number of discrete temperature and pressure conditions are applied in order to extract specific fractions from the feedstock. Each such fraction is preferably fed to individual storage. The base oil fractions extracted by the fourth evaporator generally account for about 10 to 50% of the original used oil volume; this depends to some extent on the general viscosity of the used feedstock oil. The remaining bottoms concentrate contains heavy metals from the used oil, and sediments, carbon particles, ash and various non-volatile oil additives. This bottoms concentrate is fed to storage and is suitable for use as a roofing flux, a cold patch material or an asphalt extender. Where environmental regulations permit, the bottoms concentrate may be used as a heavy fuel oil in applications such as cement kilns, blast furnaces or incinerators. Dependent on its intended usage, the evaporator conditions may be set to produce a bottoms concentrate at viscosities ranging from 380 cSt at 40 degrees Centigrade for heavy fuel to 200 cSt at 135 degrees Centigrade for asphalt use.

The distillate fractions typically amount to 85–95% of the used lubricating oil, leaving 5–15% as bottoms. The base oil distillate fractions may be treated to produce finished base oils (which have viscosities of not less than 20 cSt at 40 degrees Centigrade and have characteristics similar to those of virgin base oils). Depending on the fractions contained in the used oil and on market requirements, the base oil fractions that are typically produced are 100 SN (solvent neutral), 150 SN, 250 SN and 350+SN. If only one or two wider base oil fractions are required, the fourth evaporator may be omitted.

As an alternative to the multi-stage distillation plant described above, it is possible to utilize a single evaporator operating in a blocked manner. The various fractions may then be extracted sequentially by applying predetermined temperature and pressure conditions in the evaporator. This has the advantage over a multi-stage plant of requiring less capital expenditure, but is less efficient since continuous process conditions can not be achieved.

The raw base oil distillates may contain volatile contaminants, oxidation compounds, unstable sulphur compounds and various decomposition products from additives, depending on the type and quality of the feedstock. It is therefore advantageous to provide a finishing treatment in which base and fuel oil distillates are chemically treated in order to remove unstable or other undesirable components.

The present invention comprises a method of removing acidic compounds, color, and polynuclear aromatic hydrocarbons, and removing or substituting heteroatoms from used oil distillates, such as those produced by the foregoing process. In accordance with the broader aspects of the invention, an organic or inorganic base, a transfer catalyst, and the used oil distillate are mixed and heated. Thereafter, the contaminants are removed by distillation.

The method of the invention may be operated either in a batch mode or in a continuous mode. When the continuous mode is used, the method may be used prior to, or concurrent with, the method of U.S. Pat. No. 5,814,207 as described above. By means of the present invention, the complexity of the apparatus of the '207 Patent is substantially reduced.

BRIEF DESCRIPTION OF THE DRAWINGS

A more complete understanding of the invention may be had by reference to the following Detailed Description when taken in conjunction with the accompanying Drawings wherein.

DETAILED DESCRIPTION

Figure 1:
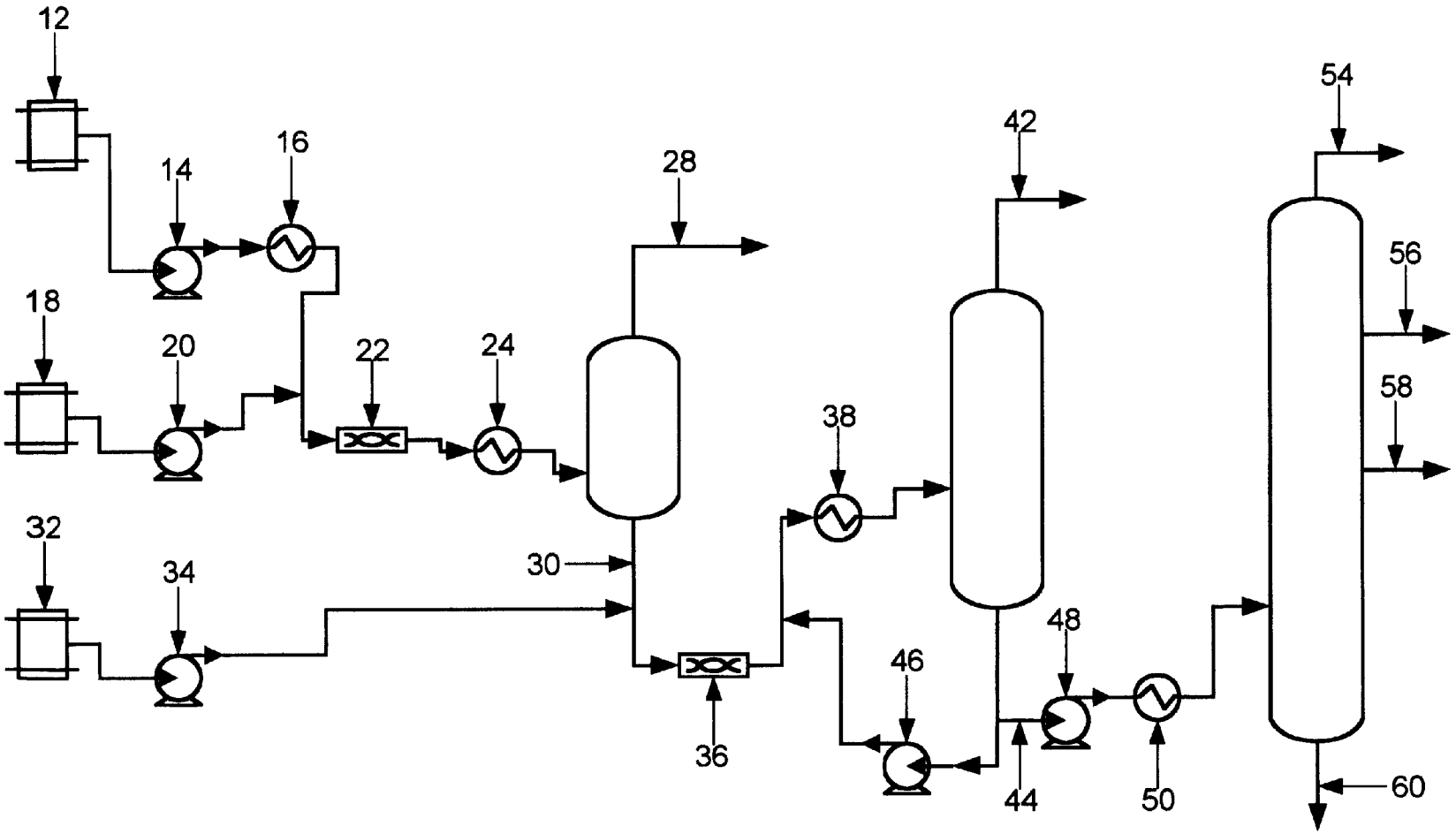
FIG. 1 is a diagrammatic illustration of an apparatus for a continuous flow catalyzed base process.

The invention is successful at removing acidic compounds and color from used oil distillate. Additionally, the invention is successful at removing or substituting hydrocarbons containing heteroatoms, namely chlorine, boron, phosphorous, sulfur and nitrogen from the distillate. In removing these classes of compounds, the process uses inorganic or organic bases to catalyze various reactions and to neutralize organic acids. Further, the invention is capable of removing polynuclear aromatic hydrocarbons from used oil. In removing these contaminants, the process makes use of a class of catalysts known as phase transfer catalysts. Phase transfer catalysts are employed in the reaction to facilitate the transfer of inorganic or organic bases to the substrate in the used oil.

In accordance with the present invention, phase transfer catalysts that may be utilized include: quaternary ammonium salts, polyol ethers, glycols and crown ethers. Through either the base catalysis or the neutralization reactions, undesirable components of the distillate oil are most often converted to forms that are easily removed from the used oil through distillation. Components that are not removed from the distillate are transposed to such a form that they may remain in the distillate with no adverse effects on the oil quality.

The invention is capable of operating in both a batch mode and a continuous flow mode. In operating in a batch process, the used oil is contacted with the phase transfer catalyst and a base. Heat is applied and the mixture is vigorously stirred. After the appropriate reaction time, the base and catalyst are washed out of the used oil with water and then the resulting oil is distilled. For best results in the batch process, the initial used oil should be wide cut oil prepurified by wide cut distillation.

In a continuous flow process, the catalyst and the base are injected into the used oil and passed through a heat exchanger to increase the temperature of the mixture. The mixture is then pumped through one or more static mixers to thoroughly mix the used oil with the catalyst and base. The mixture is then passed directly to the distillation apparatus, where additional mixing occurs and the catalyst and resulting oil are recovered separately. The catalyst is recovered in a highly purified form and is ready to be reused.

When ethylene glycol is used as the catalyst, the source of the ethylene glycol can be used glycol-based coolants. Thus, the catalyst can be acquired in raw form with little, if any, expenditure.

A further benefit of the continuous flow process is the fact that the only wastewater generated by the process is that which is originally present in the used oil and the small amount present in the base. No further water is required for the process. Additionally, all of the wastewater is recovered following distillation of the water and thus, is typically acceptable for direct discharge. If further treatment of the wastewater is required, the treatment scheme employed would be minimal.

BATCH PROCESS

Generalized Procedures

Batch reactions were carried out in a sealed Monel reactor (Parr 4842) equipped with a pressure gauge, stirrer, gas inlet, addition tube, cooling coil and thermistor. External heating was provided via a jacketed heating coil.

In the standard treatment, the reactor was charged with the waste oil, a predetermined weight percent of the chosen hydroxide salt (introduced as a 50% by weight aqueous solution) and the catalyst (introduced as a weight percent of the total mixture).

The reactor was sealed and heated to the requisite temperature for a given time. Stirring was maintained at 750 rpm.

Wide Cut Distillation

Following the reaction, the contents of the reactor were subjected to simple distillation under reduced pressure (0.1–1.0 torr). An initial cut of fuels and recovered catalyst was taken up to an atmospheric equivalent temperature ("AET") of 325 degrees Centigrade. The remaining volatiles were collected as a single fraction (AET up to 600 degrees Centigrade).

It should be mentioned that the single fraction collected following the removal of the fuel and catalyst could be directly fractionated into at least three base oil viscosity grades. However, fractionation was not performed in the examples listed below.

Extraction and Final Distillation

Equal volumes of the wide cut fraction and the extracting solvent were heated at 60 degrees Centigrade for 45 minutes with overhead stirring. The layers were separated and the oil layer subjected to distillation at reduced pressure (0.1–0.5 torr) to afford the final fractions.

SPECIFIC EXAMPLES

1. To 226 g of used oil was added KOH to 5 weight % and 1 weight % ethylene glycol. The mixture was heated to 275 degrees Centigrade for 5 hours. Following extraction with water, 183.5 g of finished oil was isolated by distillation.

2. As in method 1, using 2 weight % KOH and 10 weight % ethylene glycol. Using methanol as extraction solvent, the finished oil was isolated by distillation.

3. As in method 1, using 2 weight % NaOH and 10 weight % diethylene glycol. Using methanol as extraction solvent, the finished oil was isolated by distillation.

4. As in method 1, using 2 weight % KOH and 10 weight % diethylene glycol. Using methanol as extraction solvent, the finished oil was isolated by distillation.

5. As in method 1, using 2 weight % KOH and 10 weight % triethylene glycol. Using methanol as extraction solvent, the finished oil was isolated by distillation.

6. As in method 1, using 2 weight % NaOH and 10 weight % triethylene glycol. Using method B with methanol as extraction solvent, the finished oil was isolated by distillation.

7. As in method 1, using 5 weight % NaOH and 10 weight % ethylene glycol. Using water as extraction solvent, the finished oil was isolated by distillation.

8. As in method 1, using 2 weight % NaOH and 10 weight % diethylene glycol. Using water as extraction solvent, the finished oil was isolated by distillation.

9. As in method 1, using 2 weight % NaOH and 10 weight % triethylene glycol. Using water as extraction solvent, the finished oil was isolated by distillation.

10. As in method 1, using 2 weight % NaOH and 10 weight % triethylene glycol. Using water as extraction solvent, the finished oil was isolated by distillation.

The following characteristics apply to all of the foregoing examples:

Used Oil Characterization
150–500 ppm Cl
>8 color
very strong odor
1.0–1.5 acid number
1.0–1.5 bromine number Finished Oil Characterization
less than 5 ppm Cl
<2 color
negligible odor acid number <01
bromine number unchanged
Flow Process One embodiment of the flow process is shown in FIG. 1. The base catalyzed flow apparatus 10 allows used oil from a source 12 to pass through the used oil feed pump 14 to heater 16. At the same time, a 50% aqueous sodium or potassium hydroxide from a source 18 is passed through a caustic feed pump 20 and into the used oil after it passes through and is heated to 90° C. by heater a 16. The used oil and the sodium or potassium hydroxide passes through a caustic mixer 22 and a heater 24, heating the mixture to 140° C. The used oil mixture is then passed into the water flash drum 26 where water and a small amount of naphtha are removed through flash outlet 28. The resultant dehydrated used oil mixture is then removed from the water flash drum 26 through a flash oil outlet 30. Ethylene glycol from a source 32 is passed through a catalyst feed pump 34 and into the dehydrated used oil mixture. The used oil feed pump 14, the caustic feed pump 20, and the catalyst feed pump 34 were each engaged at flow rates that provided ratios for used oil to catalyst to caustic of 1:0.1:0.2, respectively. The used oil mixture is passed through a catalyst mixer 36 and a heater 38, where it is heated to 275° C., and proceeds into a stage I evaporator 40. The catalyst and naphtha are removed through flash catalyst outlet 42 and the oil is removed through oil outlet 44. Part of the oil passes through recycle pump 46 and back into the dehydrated used oil mixture after the catalyst mixer 36, but before the heater 38. The remainder of the oil passes through a finishing pump 48 and a heater 50, where it is heated to 345° C., and into a stage II evaporator 52. The stage II evaporator separates the oil into following fractions:

| Fraction | Color | Chlorine | Viscosity |
|---|---|---|---|
| light base oil | <0.5 | <5 ppm | 100 SUS |
| medium base oil | <1.0 | <5 ppm | 150 SUS |
| heavy base oil | <1.5 | <5 ppm | 300 SUS |
| still bottoms | n/a | n/a | n/a |

The light base oil is recovered through outlet 54, the medium base oil through outlet 56, the heavy base oil through outlet 58, and the still bottoms through outlet 60.

The still bottoms resulting from the simultaneous combination of the catalyzed base treatment with distillation yields important properties when combined with asphalt. In general, the still bottoms comprise a high value asphalt modifier, capable of extending the useful temperature range of most straight run asphalts. Specifically, the still bottoms impart favorable low temperature characteristics to asphalt, while maintaining the high temperature properties of the asphalt.

Although preferred embodiments of the invention have been illustrated in the accompanying drawings and described in the foregoing detailed description, it will be understood that the invention is not limited to the disclosed embodiments, but is capable of numerous rearrangements, modifications, and substitutions of parts and elements without departing from the spirit of the invention.

We claim:

1. A method of purifying used oil comprising the steps of:

placing used oil into a continuous flow apparatus;

contacting the used oil with a base introduced at such a rate as to maintain the base at about 1 weight % to about 10 weight % of the oil composition;

contacting the used oil with a phase transfer catalyst introduced at such a rate as to maintain the phase transfer catalyst at about 1 weight % to about 10 weight % of the oil composition;

heating the composition to a temperature between about 200° C. and about 275° C.;

mixing the composition;

separating at least the catalyst from the resultant mixture using a first distillation at a temperature of from about 200° C. to about 275° C. and a pressure of from about 100 torr to about 200 torr; and fractionating the used oil using a second distillation at a temperature of from about 275° C. to about 300° C. and a pressure of from about 0.05 torr to about 0.20 torr.

2. The method as recited in claim 1 additionally comprising the step of:

heating the oil composition obtained from the first distillation to a temperature between about 200° C. and about 300° C.; and mixing the composition after the first distillation but before the second distillation.

3. A method of purifying used oil comprising the steps of:

placing used oil into a continuous flow apparatus;

contacting the used oil with a base selected from the group including sodium hydroxide and potassium hydroxide introduced at such a rate as to maintain the base at about 1 weight % to about 10 weight % of the oil composition;

contacting the used oil with ethylene glycol introduced at such a rate as to maintain the phase transfer catalyst at about 1 weight % to about 10 weight % of the oil composition;

heating the composition to a temperature between about 200° C. and about 275° C.;

mixing the composition;

separating the catalyst and light hydrocarbons from the resultant mixture using a first distillation at a temperature of from about 200° C. to about 275° C. and a pressure of from about 100 torr to about 200 torr, and fractionating the used oil using a second distillation at a temperature of from about 275° C. to about 350° C. and a pressure of from about 0.05 torr to about 0.20 torr.

4. The method as recited in claim 1 wherein the phase transfer catalyst is selected from the group consisting of quaternary ammonium salts, polyol ethers, glycols and crown ethers.

5. The method as recited in claim 4 wherein the phase transfer catalyst is an aylene glycol.

6. The method as recited in claim 1 wherein the steps of heating and mixing are at least partially simultaneous.

7. The method as recited in claim 1 wherein the base is an organic base.

8. The method as recited in claim 1 wherein the base is an inorganic base.

9. The method as recited in claim 1 wherein the first distillation step separates the catalyst and light hydrocarbons from the mixture.

* * * * *

UNITED STATES PATENT AND TRADEMARK OFFICE

CERTIFICATE OF CORRECTION

PATENT NO. : 6,007,701
DATED : December 28, 1999
INVENTOR(S) : Jeffrey H. Sherman, et. al.

It is certified that error appears in the above-identified patent and that said Letters Patent is hereby corrected as shown below:

Col. 1, line 24, replace "can not" with --cannot--.

Col. 1, line 52, replace "war" with --War--.

Col. 2, line 29, replace "re flux" with --reflux--.

Col. 2, line 33, replace "rerefining" with --re-refining--.

Col. 3, line 13, add a "," after "vacuum."

Col. 3, line 30, add a "," after "vacuum."

Col. 4, line 33, replace "can not" with --cannot--.

Col. 7, line 1, replace "01" with --0.1--.

Col. 7, line 10, replace "a 16" with --16--.

Col. 7, line 23, add "52" before "separates".

Col. 8, claim 5, line 31, replace "aylene" with --alkylene--.

Signed and Sealed this

Twenty-sixth Day of December, 2000

*Attest:*

Q. TODD DICKINSON

*Attesting Officer*

*Director of Patents and Trademarks*